US010807358B2

(12) United States Patent
Byun et al.

(10) Patent No.: US 10,807,358 B2
(45) Date of Patent: Oct. 20, 2020

(54) PRINTING APPARATUS

(71) Applicant: ENJET CO. LTD., Suwon-si (KR)

(72) Inventors: Do Young Byun, Seoul (KR); Vu Dat Nguyen, Suwon-si (KR)

(73) Assignee: ENJET CO. LTD., Suwon-si (KR)

( * ) Notice: Subject to any disclaimer, the term of this patent is extended or adjusted under 35 U.S.C. 154(b) by 0 days.

(21) Appl. No.: 16/357,352

(22) Filed: Mar. 19, 2019

(65) Prior Publication Data

US 2019/0291415 A1 Sep. 26, 2019

(30) Foreign Application Priority Data

Mar. 20, 2018 (KR) ..... 10-2018-0032101

(51) Int. Cl.
*B41J 2/045* (2006.01)
*B41J 25/304* (2006.01)

(52) U.S. Cl.
CPC ..... *B41J 2/04508* (2013.01); *B41J 2/04586* (2013.01); *B41J 25/304* (2013.01)

(58) Field of Classification Search
CPC ..... B41J 2/045081; B41J 2/04586; B41J 2/04588; B41J 2/04593; B41J 11/06; B41J 2/2132; B41J 2/2135; B05B 12/12; B05B 1/02; G06T 2207/30148; G06T 7/001; H01L 51/56; H01L 51/0005; H01L 21/6715; H01L 21/67282; H01L 21/681; H01L 21/76838
See application file for complete search history.

(56) References Cited

U.S. PATENT DOCUMENTS 10,369,782 B2 * 8/2019 Momose ..... B41J 2/04586
2006/0144331 A1 * 7/2006 Hanafusa ..... G01N 35/1016 118/712

FOREIGN PATENT DOCUMENTS

JP 2008-200582 9/2008
KR 10-2006-0032857 4/2006

* cited by examiner

*Primary Examiner* — Thinh H Nguyen

(57) ABSTRACT

Disclosed is a printing apparatus. In an exemplary embodiment, the printing apparatus includes a nozzle for ejecting ink, a driving device for moving the nozzle, an imaging device for capturing an image displaying an ink printing process, and an automatic positioning controller for automatically setting a position of the nozzle based on the image captured by the imaging device while moving the nozzle by means of the driving device.

7 Claims, 9 Drawing Sheets

PRINTING APPARATUS

RELATED APPLICATION

This application claims the benefit of priority of Korean Patent Application No. 10-2018-0032101 filed on Mar. 20, 2018, the contents of which are incorporated herein by reference in their entirety.

FIELD AND BACKGROUND OF THE INVENTION

The present invention relates to a printing apparatus, and more particularly, to a printing apparatus, which can automatically align the position of a nozzle when the apparatus is turned on or initialized or when the nozzle is replaced.

In general, an ink injecting apparatus for injecting a fluid in forms of droplets has been typically employed to an inkjet printer. In recent years, however, an ink injecting apparatus are widely being used in the advanced industry including, a display manufacturing process, a printed circuit board manufacturing process, or a DNA chip manufacturing process.

The ink injecting apparatus discharges droplets from fluid-state ink and is largely divided into a thermal type apparatus and a piezoelectric type apparatus according to droplet discharge method. Recently, for ultrafine printing, an electrostatic jet printer based on an electrodynamic process is widely being used.

The electrostatic jet printer jets ink using an electrostatic force based on an electric potential difference generated by applying a voltage between a nozzle and a board. The electrostatic jet printer discharges droplets or continuous jets using a force of pulling a liquid surface by an electrostatic force. Thus, unlike another type of conventional jet printers, the electrostatic jet printer is known to have various advantages including capabilities of nano-scale patterning, highly viscous ink discharging, uniform droplet generation, and so on.

The conventional electrostatic jet printers perform printing while continuously supplying ink into a nozzle using a pump. Here, it is often the case that the nozzle needs to be replaced for performing various line-width printing operations. In addition, in a case of using a cartridge type nozzle, the nozzle needs to be replaced when ink is used up. As described above, when the nozzle needs to be replaced or a printing apparatus is turned on or initialized, it is necessary to align the nozzle in position. Conventionally, the position of a nozzle tip was manually adjusted by an operator while moving the nozzle in x-y-z directions. Therefore, a great deal of time was required in alignment of the nozzle and an alignment error may be caused according to the operator's technical skill or dexterity.

CITATION LIST

Patent Publication (publication No. 1): Korean laid-open publication 10-2014-0036600

SUMMARY OF THE INVENTION

The present invention has been made in an effort to solve the problems of the prior art, and it is an object of the present invention to provide a printing apparatus and a nozzle aligning method, which can automatically align the position of a nozzle rapidly using an image of a camera.

The above and other objects of the present invention will be described in or be apparent from the following description of the preferred embodiments.

According to an aspect of the present invention, there is provided a printing apparatus including a nozzle for ejecting ink, a driving device for moving the nozzle, an imaging device for capturing images displaying an ink printing process, and an automatic positioning controller for moving the nozzle by means of the driving device and automatically controlling a position of the nozzle based on the images captured by the imaging device.

Here, the nozzle may be disposed at an angle with respect to a vertical direction.

Here, the imaging device may include at least one of a first camera capturing an image in a vertical direction from the top to the bottom, and a second camera capturing an image in a tilted direction.

Here, the printing apparatus may further include a lighting device disposed to be opposed to the imaging device and irradiating light to the nozzle positioned between the imaging device and the lighting device.

Here, the automatic positioning controller may be configured to set the position of the nozzle by controlling the driving device to position the nozzle tip at the center of the image captured by the imaging device and by controlling the driving device to maximize the sharpness of a nozzle image captured by the imaging device.

In addition, the automatic positioning controller may set the position of the nozzle by controlling the driving device so as to maximize the sharpness of an image of the nozzle tip.

Further, the automatic positioning controller may automatically set the position of the nozzle based on the nozzle image included in the image captured by the imaging device and a mirrored nozzle image reflected on a substrate to which the ink adheres.

Here, the automatic positioning controller may be configured to determine a distance between the nozzle and the substrate based on a distance between the nozzle image and the mirror image of the nozzle.

Here, the imaging device may be configured to recognize a pattern of printed ink as the ink is printed on the substrate through the nozzle, and the automatic positioning controller may be configured to set absolute coordinates of the nozzle based on the pattern of printed ink.

As described above, in the printing apparatus according to the present invention, the position of a nozzle can be automatically aligned rapidly using an image of a camera without the need for an operator to manually align the nozzle position of the nozzle when the apparatus is turned on or initialized or when the nozzle is replaced.

In addition, in the printing apparatus according to the present invention, since the nozzle position is automatically aligned, an alignment error caused by an operator may not be created.

DESCRIPTION OF SPECIFIC EMBODIMENTS OF THE INVENTION

Hereinafter, the present invention will be described in detail.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like numbers refer to like elements throughout.

Hereinafter, the present invention will be described through embodiments of a printing apparatus according to the present invention with reference to the accompanying drawings.

Figure 1:
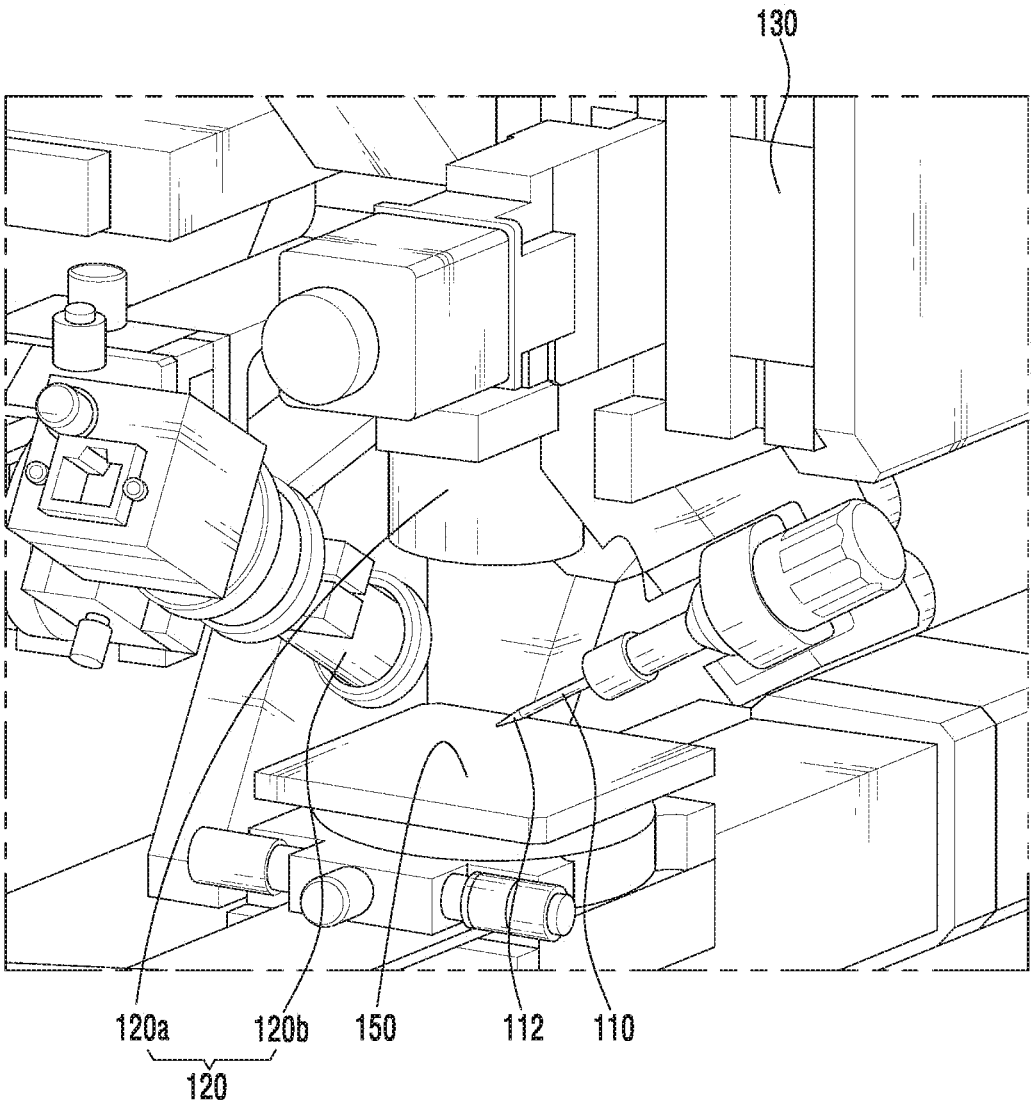
FIG. 1 is a perspective view of a printing apparatus according to an embodiment of the present invention.

FIG. 1 is a perspective view of a printing apparatus according to an embodiment of the present invention.

The printing apparatus according to an embodiment of the present invention may include a nozzle 110, a driving device 140, an imaging device 120, and an automatic positioning controller (not shown).

First, the present invention will be described with regard to an electrostatic jet printer based on an electrodynamic process for ultrafine printing, but aspects of the present invention are not limited thereto. The technical features of the present invention can be applied to another type of a printer of injecting ink using the nozzle so as to align the position of the nozzle 110.

The nozzle 110 includes a chamber (not shown) accommodating ink therein and discharges ink through a nozzle tip 112 toward a substrate S mounted on a stage 150. FIG. 1 illustrates the nozzle 110 of a cartridge type, which can be a detachably replaced, but not limited thereto. In this embodiment, the nozzle 110 of a capillary type, which is widely used in an electrostatic jet printer, is used. Here, in order to perform printing and watching the substrate S in real time by a first camera 120*a* capturing an image in a direction from the top to the bottom, the nozzle 110 may be disposed under the first camera 120*a* in a tilted direction.

The driving device 140 may move the nozzle 110 in x-, y-, and z-axis directions and may include an x-axis motor, a y-axis motor, and a z-axis motor. The driving device 140 for moving the nozzle 110 in the x-, y-, and z-axis directions which are perpendicular to one another may have the same configuration as known in the art, and a detailed description thereof will not be given.

The imaging device 120 photographs and monitors in real time the ink printing process by means of the nozzle 110 and a state of the substrate S. Here, the imaging device 120 may include the first camera 120*a* capturing images of the nozzle 110 and the substrate S in a direction from the top to the bottom, and a second camera (tilted camera) 120*b* capturing images of the nozzle 110 and the substrate S from a side of the nozzle 110*a* in a tilted direction. The imaging device 120 having a structure including both of the first camera 120*a* and the second camera 120*b* mounted thereon is illustrated and described in this embodiment.

The automatic positioning controller controls the driving device 140 to move the nozzle 110 and automatically sets the position of the nozzle 110 using images of the nozzle 110, which are captured by the imaging device 120. Here, the automatic positioning controller may automatically align the nozzle 110 at the center of the image captured by the first camera 120*a* and at the center of the image captured by the second camera 120*b* and may align the nozzle 110 within a depth of field (DOF) of the first camera 120*a* and the second camera 120*b*, may align the nozzle 110 by adjusting a distance between the nozzle tip 112 and the substrate S to a predetermined value, or may automatically set absolute coordinates of the nozzle 110, which will later be described in detail with reference to FIGS. 2 to 9.

The lighting device 130 is disposed to be opposed to the imaging device 120 and irradiates light to the nozzle 110 positioned between the imaging device 120 and the lighting device 130. Here, the imaging device 120 is capable of capturing a clear image of the nozzle 110 using the light irradiated from the lighting device 130.

A process of automatically aligning the nozzle 110 at the center of an image captured by a camera within a depth of field will now be described through an embodiment with reference to FIGS. 2 to 5.

Figure 2:
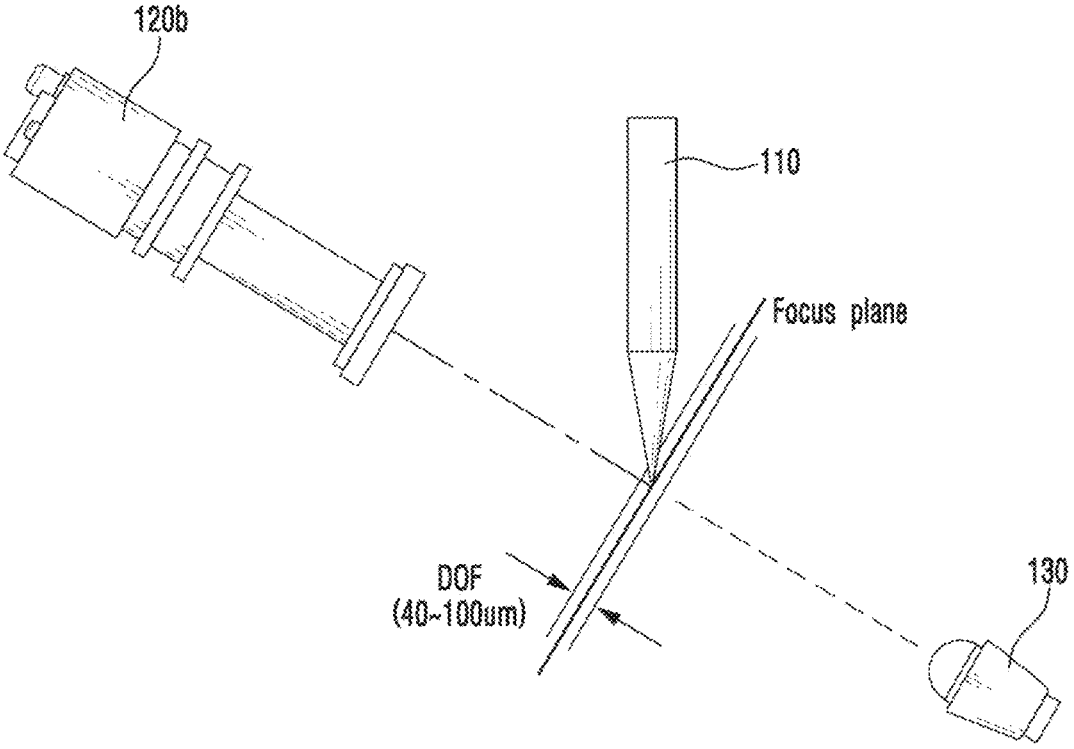
FIG. 2 is a conceptual diagram illustrating a process of aligning a nozzle tip at positions of the center of a second camera image and a depth of field using a second camera (tilted camera) capturing an image in a tilted direction.
Figure 3:
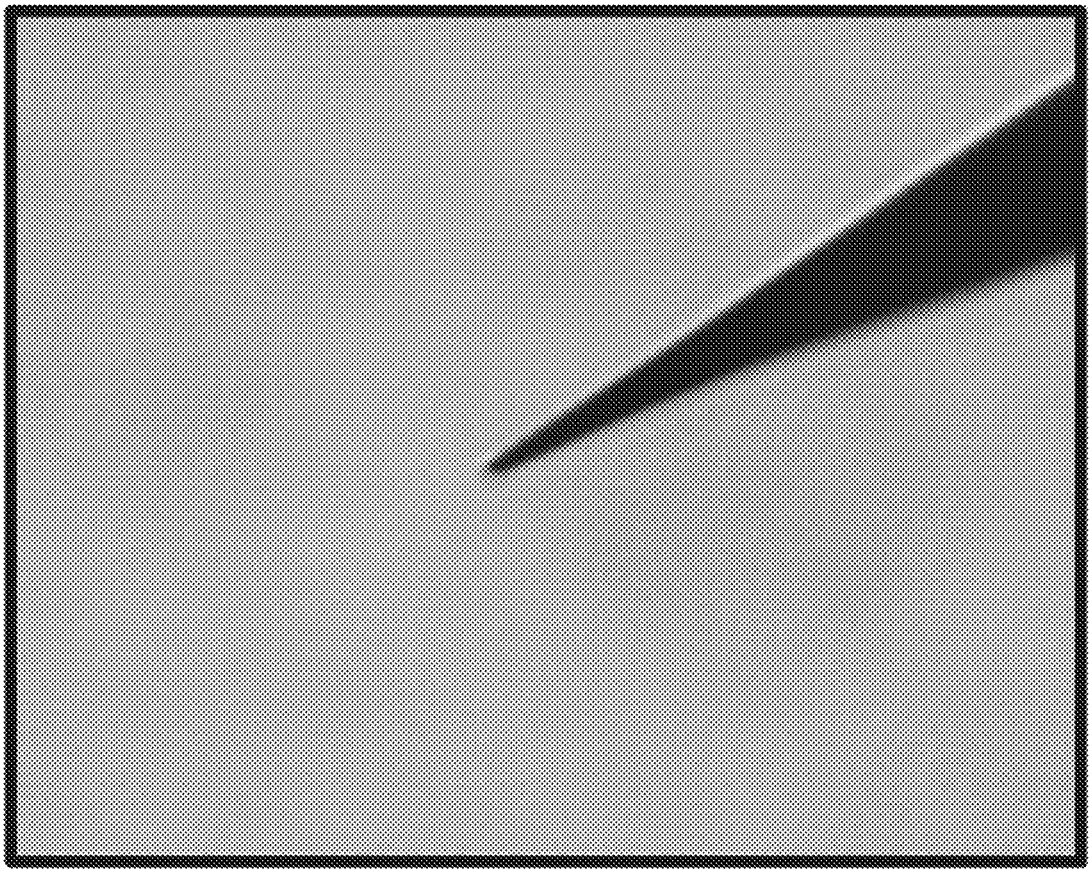
FIG. 3 illustrates a nozzle tip image captured by the second camera illustrated in FIG. 2.
Figure 4:
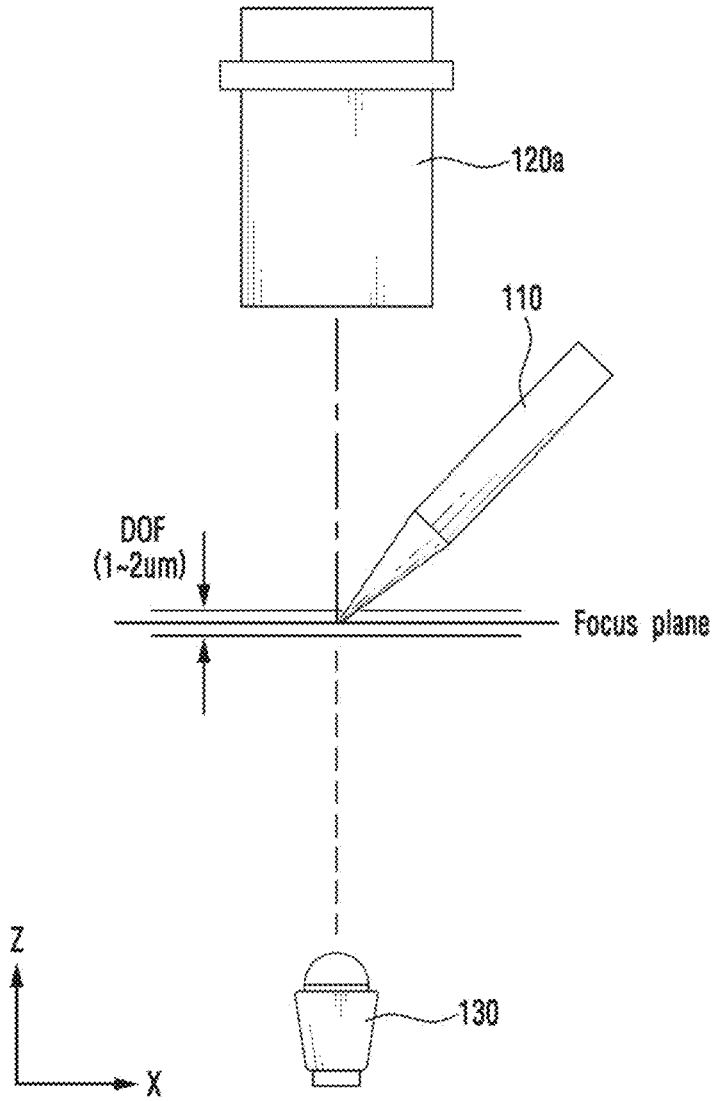
FIG. 4 is a conceptual diagram illustrating a process of aligning a nozzle tip at positions of the center of a first camera image and a depth of field using a first camera capturing an image in a direction from the top to the bottom.
Figure 5:
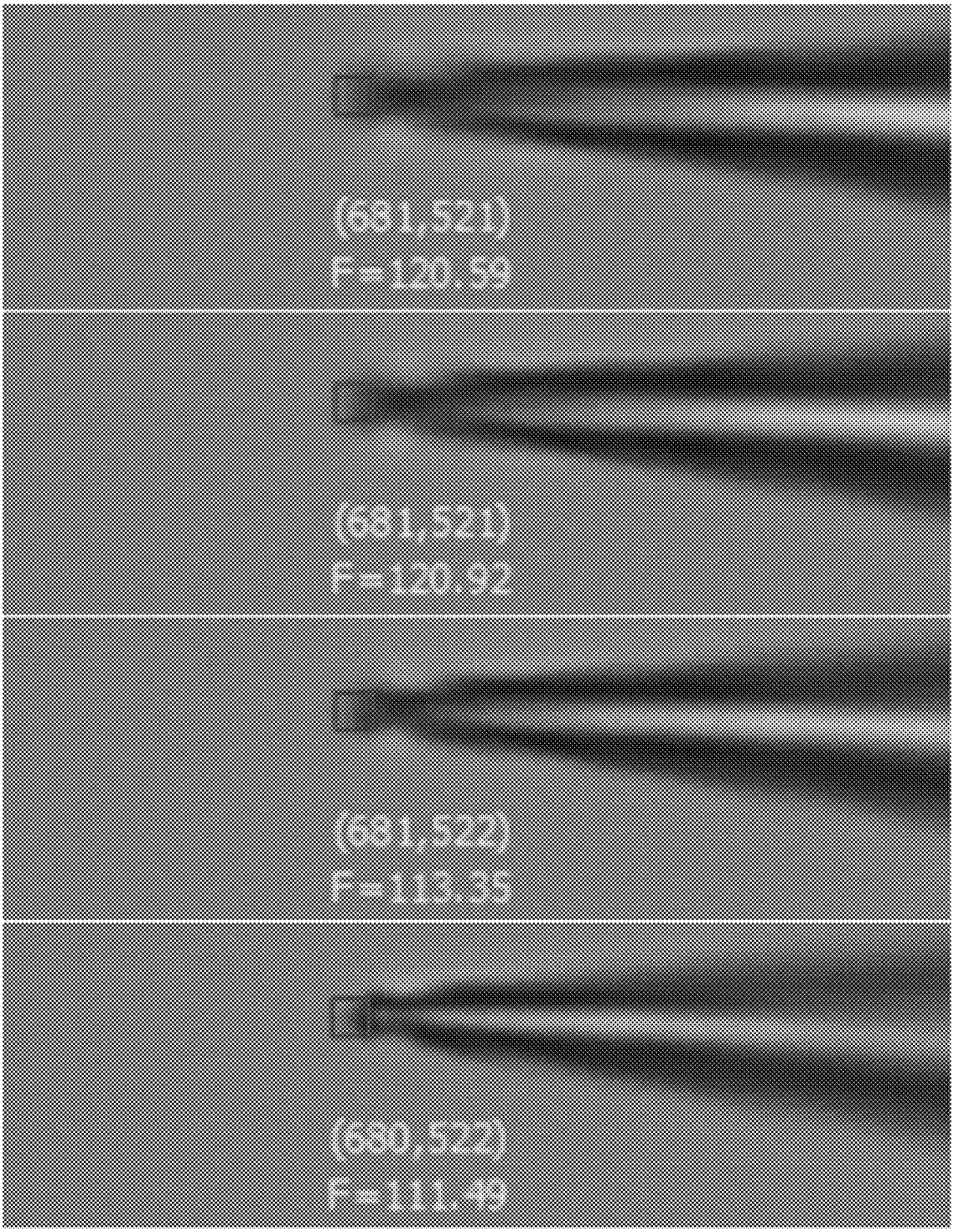
FIG. 5 illustrates nozzle tip images captured by the first camera while moving positions of the nozzle tip illustrated in FIG. 4.

FIG. 2 is a conceptual diagram illustrating a process of aligning a nozzle tip at positions of the center of a second camera image and a depth of field, using a second camera (tilted camera) capturing an image in a tilted direction, FIG. 3 illustrates a nozzle tip image captured by the second camera illustrated in FIG. 2, FIG. 4 is a conceptual diagram illustrating a process of aligning a nozzle tip at positions of the center of a first camera image and a depth of field, using a first camera capturing an image in a direction from the top to the bottom, and FIG. 5 illustrates nozzle tip images captured by the first camera while moving positions of the nozzle tip illustrated in FIG. 4.

In order to rapidly perform a printing operation and an image capturing process using a camera, it is necessary to align the nozzle tip 112 at the center of a camera image within a depth of field as fast as possible.

First, a process of aligning the nozzle 110 with the second camera 120*b* capturing an image in a tilted direction will be described with reference to FIGS. 2 and 3.

The automatic positioning controller positions the nozzle tip 112 at the center of the image captured by the second camera 120*b* and the DOF of the second camera 120*b*. As illustrated in FIG. 2, the LED lighting device 130 may be disposed to be opposed to the second camera 120*b* to irradiate light to the second camera 120*b*, and the automatic positioning controller may analyze the image captured by the second camera 120*b* and may control the driving device 140 so as to position the nozzle tip 112 at the center of the image.

In analyzing the image of the nozzle 110 captured by the second camera 120*b*, the driving device 140 may be controlled such that the nozzle tip 112 is aligned at a position where a gradient between a pixel value of a shadow image of the nozzle 110 and a pixel value of a surrounding area is maximized, that is, a position where the sharpness of the image of the nozzle 110 is maximized. In the above-described manner, the nozzle 110 may be aligned such that the nozzle tip 112 is positioned at the center of the image of the second camera 120*b* and is positioned within a range of DOF of the second camera 120*b* (i.e., 40-100 μm). FIG. 3 illustrates an image of the nozzle tip 112, which is acquired by the second camera 120*b*.

Next, a process of aligning the nozzle 110 with the first camera 120*a* capturing an image in a direction from the top to the bottom will be described with reference to FIGS. 4 and 5.

The automatic positioning controller aligns the nozzle 110 such that the nozzle tip 112 is positioned at the center of the image captured by the first camera 120*a* and is positioned within a range of DOF of the first camera 120*a* (i.e., 1-2 μm). As illustrated in FIG. 4, the LED lighting device 130 may also be disposed to be opposed to the first camera 120*a* to irradiate light to the first camera 120*a*, and the automatic positioning controller may analyze the image captured by the first camera 120*a* to control the driving device 140 to allow the nozzle tip 112 to be positioned at the center of the image.

Here, the driving device 140 is controlled to move the nozzle 110 in the Z-axis direction so as to position the nozzle 110 within the range of DOF of the first camera 120*a*. FIG. 5 illustrates images of the first camera 120*a*, which are taken during the movement of the nozzle 110 in the Z-axis direction. In this embodiment, a position where the image at the bottom having the maximum of sharpness of the nozzle tip 112 is taken is determined and then, the nozzle 110 is aligned based on the determined position such that the nozzle tip 112 is positioned within the range of the DOF of the first camera 120*a*.

Therefore, in the present invention, the nozzle tip 112 can be automatically aligned based on a camera.

Next, a process of automatically setting a distance between a substrate S and the nozzle tip 112 will be described with reference to FIGS. 6 to 8.

Figure 6:
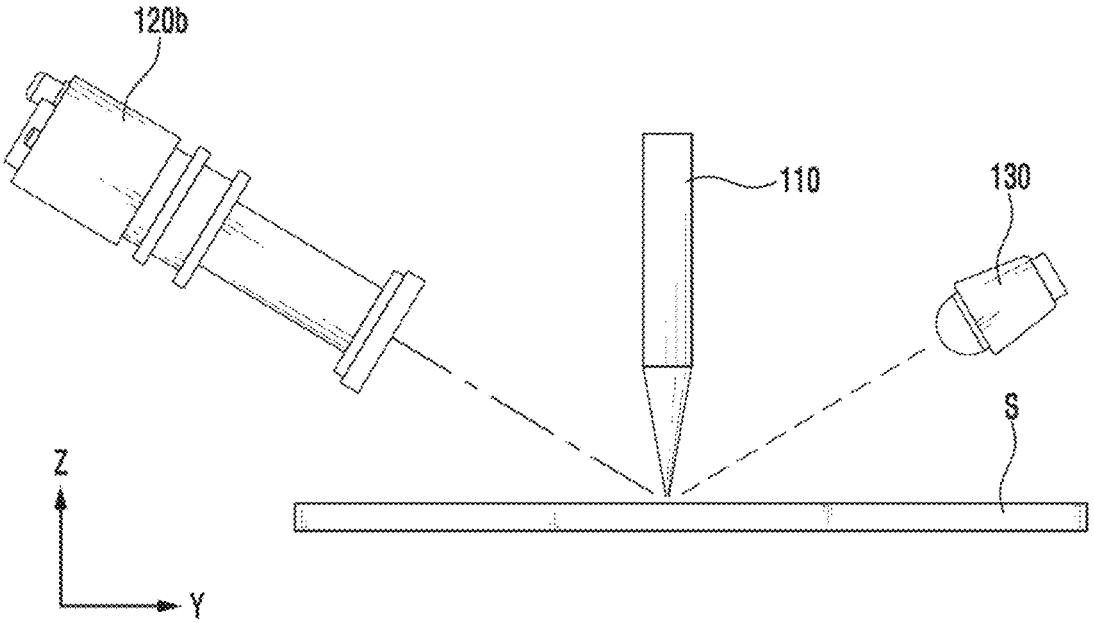
FIG. 6 is a conceptual diagram illustrating a process of adjusting a distance between a substrate and a nozzle tip using a second camera capturing an image in a tilted direction.
Figure 7:
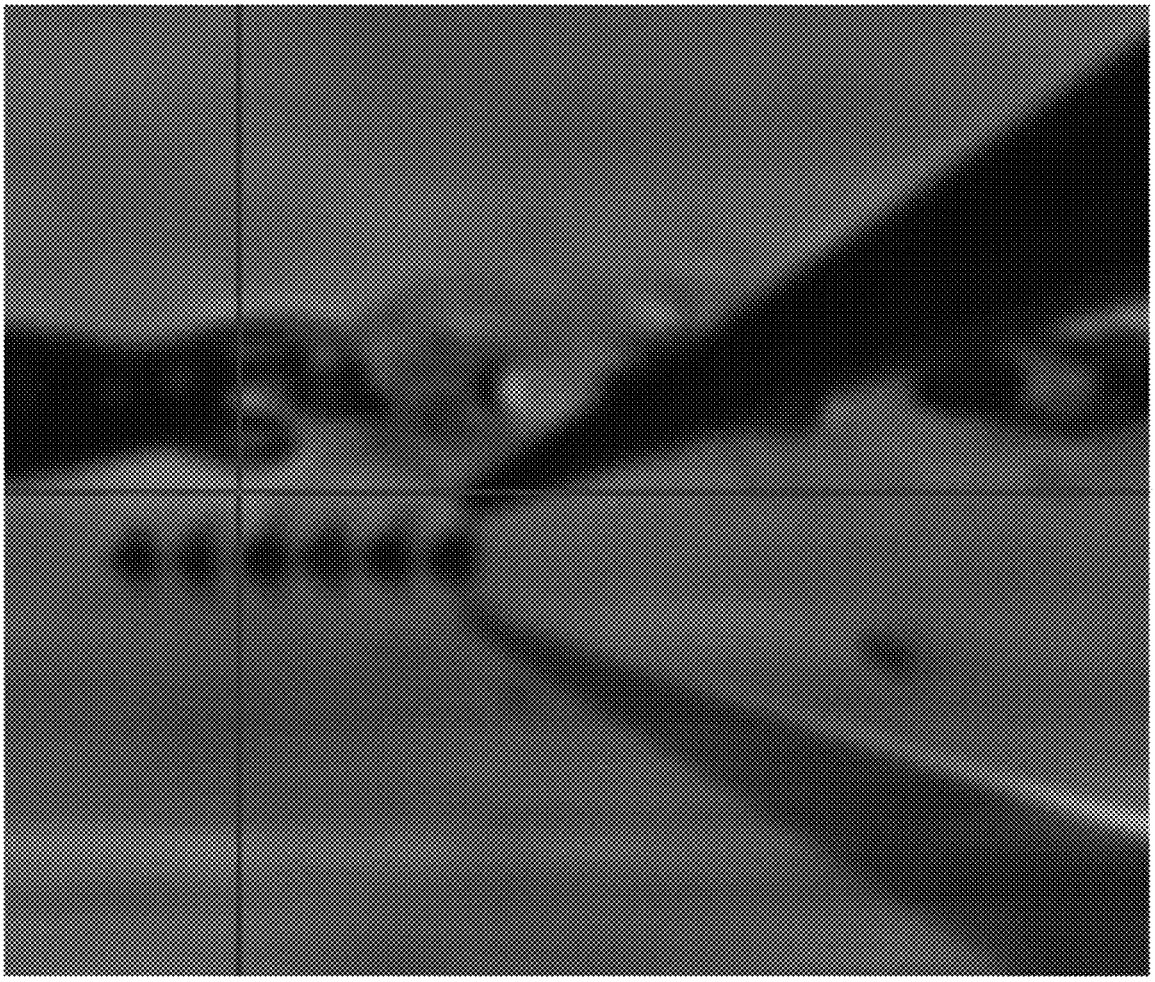
FIG. 7 illustrates images captured by the second camera illustrated in FIG. 6.
Figure 8:
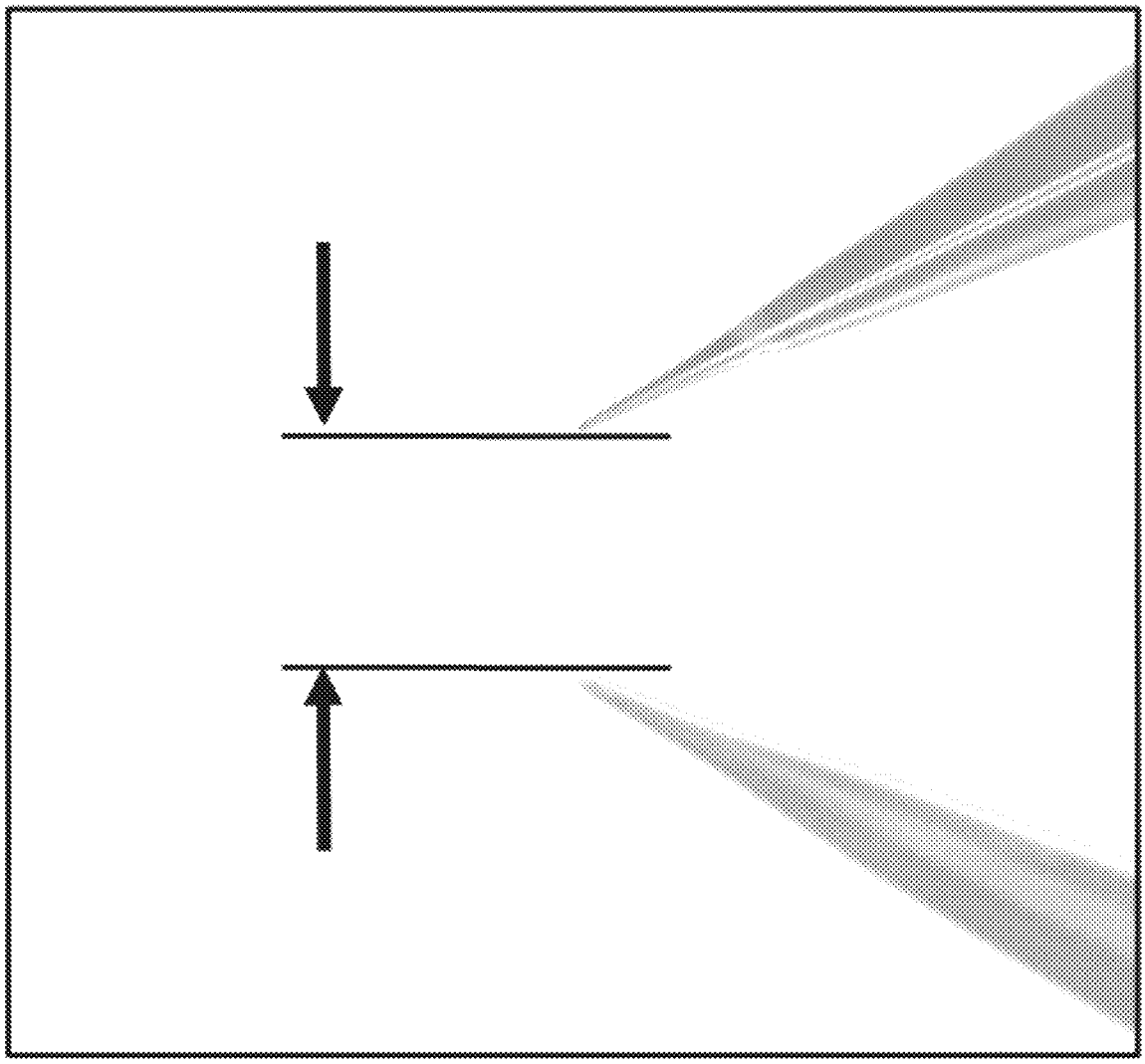
FIG. 8 illustrates images with noises removed therefrom by performing image processing on the images illustrated in FIG. 7.

FIG. 6 is a conceptual diagram illustrating a process of adjusting a distance between a substrate and a nozzle tip, using a second camera capturing an image in a tilted direction, FIG. 7 illustrates images captured by the second camera illustrated in FIG. 6, and FIG. 8 illustrates images with noises removed therefrom by performing image processing on the images illustrated in FIG. 7.

The image of the nozzle 110 positioned on the substrate S can be obtained from the second camera 120*b* capturing an image in a tilted direction. Here, the nozzle 110 is disposed in a tilted direction, as described above. Therefore, as illustrated in FIG. 7, the obtained image may include not only the image of the nozzle 110 but also a mirror image of the nozzle 110 which is reflected on the substrate S. FIG. 8 illustrates an image obtained by an image processing on the images illustrated in FIG. 7, in which only the image of the nozzle 110 and its mirror image were left clearly and the remaining images were removed as noises.

Here, as the nozzle tip 112 becomes farther away from a top surface of the substrate S, a distance between the two images, which are the image of the nozzle 110 and the mirror image of the nozzle 110, is increased. As the nozzle tip 112 becomes closer to the top surface of the substrate S, the distance between the two images is decreased. Therefore, a distance between the substrate S and the nozzle tip 112 can be determined based on the distance between the image of the nozzle 110 and the mirror image of the nozzle 110.

Next, a process of determining absolute coordinates of the nozzle 110 will be described with reference to FIG. 9.

Figure 9:
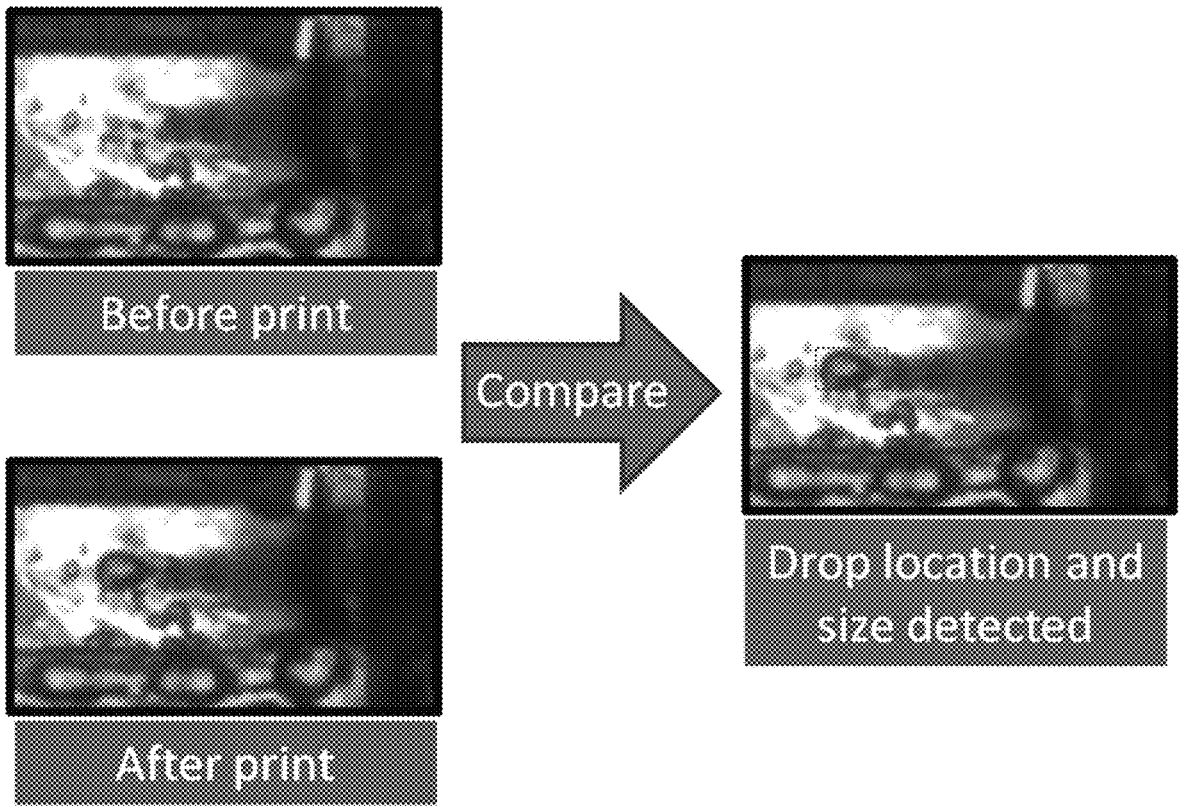
FIG. 9 illustrates a process of determining absolute coordinates of a nozzle by printing ink on a substrate.

FIG. 9 illustrates a process of determining absolute coordinates of a nozzle by printing ink on a substrate S.

As illustrated in FIG. 9, ink is printed on a predetermined position of the substrate S, and the imaging device 120 acquires an image of a pattern for the printed ink. The automatic positioning controller recognizes the pattern and position of the image to determine absolute coordinates of the nozzle 110 based on the recognized pattern and position. In order to accurately adhere droplets of the ink jetted from the nozzle 110 onto a desired location, it is necessary to obtain the absolute coordinates of the nozzle 110. Therefore, as described above, the shape and location of the pattern of the ink printed at the predetermined position are recognized and the absolute coordinates of the nozzle 110 can be determined therefrom.

When the printing apparatus is turned on or initialized, or when the nozzle 110 is replaced, it is necessary to position the nozzle 110 within the range of a camera view and locate the nozzle 110 within a distance of focus. In addition, in order to perform printing, it is necessary to adjust a distance between the nozzle 110 and the substrate S. Further, in order to detect a position of the ink being jetted, it is necessary to set the absolute coordinates of the nozzle 110.

Therefore, according to the present invention, the images acquired from the cameras 120*a* and 120*b* by the process described above with reference to FIGS. 2 to 5 may be analyzed to allow the nozzle 110 to be positioned at the center of camera view and to be positioned within the DOF ranges of the cameras 120*a* and 120*b*. In addition, according to the present invention, the images acquired from the cameras 120*a* and 120*b* by the process described above with reference to FIGS. 6 to 8 may be analyzed to determine the distance between the nozzle 110 and the substrate S or to maintain the distance between the nozzle 110 and the substrate S within a predetermined distance. Further, according to the present invention, the pattern image of the ink adhered onto the predetermined position of the substrate S, which is acquired from the cameras 120*a* and 120*b* by the process described above with reference to FIG. 9, may be analyzed to set the absolute coordinates of the nozzle 110.

Here, the respective processes for printing may be sequentially performed or only some of the processes may be optionally performed.

While the present invention has been particularly shown and described with reference to exemplary embodiments thereof, it will be understood by those of ordinary skill in the art that various changes in form and details may be made therein without departing from the spirit and scope of the present invention as defined by the following claims.

Explanation of important reference numerals

| | |
|---|---|
| 110: Nozzle | 112: Nozzle tip |
| 120a: First camera | 120b: Second camera |
| 130: Lighting device | 140: Driving device |
| 150: Stage | S: Substrate |

What is claimed is:

1. A printing apparatus comprising:

a nozzle for ejecting ink;

a driving device for moving the nozzle;

an imaging device for capturing images displaying an ink printing process; and an automatic positioning controller for moving the nozzle by means of the driving device and automatically controlling a position of the nozzle based on the images captured by the imaging device, wherein the imaging device includes at least one of a first camera capturing an image in a vertical direction from the top to the bottom, and a second camera capturing an image in a tilted direction, wherein the automatic positioning controller is configured to automatically set a position of the nozzle in a vertical direction based on a nozzle image included in the image captured by the imaging device and a mirror image of the nozzle reflected on a substrate to which the ink adheres, and the nozzle image and the mirror image are captured by the second camera.

2. The printing apparatus of claim 1, wherein the nozzle is disposed at an angle with respect to a vertical direction.

3. The printing apparatus of claim 1, further comprising a lighting device disposed to be opposed to the imaging device and irradiating light to the nozzle positioned between the imaging device and the lighting device.

4. The printing apparatus of claim 1, wherein the automatic positioning controller is configured to set the position of the nozzle by controlling the driving device to position a nozzle tip at the center of the image captured by the imaging device and by controlling the driving device to maximize a sharpness of a nozzle image captured by the imaging device.

5. The printing apparatus of claim 4, wherein the automatic positioning controller is configured to set the position of the nozzle by controlling the driving device to maximize a sharpness of an image of the nozzle tip.

6. The printing apparatus of claim 1, wherein the automatic positioning controller is configured to determine a distance between the nozzle and the substrate based on a distance between the nozzle image and the mirror image of the nozzle.

7. The printing apparatus of claim 1, wherein the imaging device is configured to recognize a pattern of printed ink as the ink is printed on the substrate through the nozzle, and the automatic positioning controller is configured to set absolute coordinates of the nozzle based on the pattern of printed ink.

* * * * *